US010332661B2

(12) United States Patent
Lewis et al.

(10) Patent No.: US 10,332,661 B2
(45) Date of Patent: Jun. 25, 2019

(54) RARE EARTH-FREE PERMANENT MAGNETIC MATERIAL

(75) Inventors: Laura H. Lewis, Boston, MA (US); Katayun Barmak, White Plains, NY (US)

(73) Assignees: Northeastern University, Boston, MA (US); Carnegie Mellon University, Pittsburgh, PA (US)

( * ) Notice: Subject to any disclaimer, the term of this patent is extended or adjusted under 35 U.S.C. 154(b) by 462 days.

(21) Appl. No.: 14/232,830

(22) PCT Filed: Jul. 16, 2012

(86) PCT No.: PCT/US2012/046935

§ 371 (c)(1),
(2), (4) Date: Jan. 14, 2014

(87) PCT Pub. No.: WO2013/010173

PCT Pub. Date: Jan. 17, 2013

(65) Prior Publication Data

US 2014/0210581 A1 Jul. 31, 2014

Related U.S. Application Data

(60) Provisional application No. 61/507,881, filed on Jul. 14, 2011, provisional application No. 61/507,845,
(Continued)

(51) Int. Cl.
*H01F 1/01* (2006.01)
*H01F 1/06* (2006.01)
(Continued)

(52) U.S. Cl.
CPC ..... *H01F 1/01* (2013.01); *C22C 1/0433* (2013.01); *C22C 19/03* (2013.01); *C22C 30/00* (2013.01);
(Continued)

(58) Field of Classification Search
CPC ..... H01L 43/10; G11C 11/161; G11B 5/84; H01F 1/01; H01F 10/123; H01F 10/131; C22C 19/03
(Continued)

(56) References Cited

U.S. PATENT DOCUMENTS 4,312,684 A 1/1982 Chraplyvy et al.
5,051,856 A 9/1991 Narishige et al.
(Continued)

FOREIGN PATENT DOCUMENTS

JP 59-127226 7/1984
JP 59127226 A * 7/1984
(Continued)

OTHER PUBLICATIONS

L.H. Lewis, et al., "Inspired by nature: investigating tetrataenite for permanent magnet applications", Journal of Physics: Condensed Matter, Jan. 27, 2014, vol. 26, No. 6, 10 pgs.
(Continued)

*Primary Examiner* — Weiping Zhu
(74) *Attorney, Agent, or Firm* — Arent Fox LLP

(57) ABSTRACT

The invention provides rare earth-free permanent magnetic materials and methods of making them. The materials can be used to produce magnetic structures for use in a wide variety of commercial applications, such as motors, generators, and other electromechanical and electronic devices. Magnets fabricated using the materials can be substituted for magnets requiring rare earth elements that are costly and in limited supply. The invention provides two different types of magnetic materials. The first type is based on an iron-nickel alloy that is doped with one or more doping elements to promote the formation of $L1_0$ crystal structure. The second type is a nanocomposite particle containing magnetically hard and soft phases that interact to form an exchange spring mag-
(Continued)

netic material. The hard phase contains Fe or FeCo, and the soft phase contains AlMnC.

3 Claims, 3 Drawing Sheets

Related U.S. Application Data filed on Jul. 14, 2011, provisional application No. 61/595,344, filed on Feb. 6, 2012, provisional application No. 61/637,510, filed on Apr. 24, 2012.

(51) Int. Cl.

| | |
|---|---|
| ***H01F 1/047*** | (2006.01) |
| ***C22C 19/03*** | (2006.01) |
| ***C22C 30/00*** | (2006.01) |
| ***C22C 38/08*** | (2006.01) |
| ***H01F 41/02*** | (2006.01) |
| ***C22C 1/04*** | (2006.01) |
| ***C22C 33/02*** | (2006.01) |
| *B22F 1/00* | (2006.01) |
| *B22F 9/08* | (2006.01) |

(52) U.S. Cl.
CPC ..... *C22C 33/02* (2013.01); *C22C 38/08* (2013.01); *H01F 1/047* (2013.01); *H01F 1/068* (2013.01); *H01F 41/0253* (2013.01); *H01F 41/0266* (2013.01); *B22F 1/0018* (2013.01); *B22F 2009/0812* (2013.01); *B22F 2998/10* (2013.01); *C22C 2202/02* (2013.01)

(58) Field of Classification Search
USPC ..... 335/302
See application file for complete search history.

(56) References Cited

U.S. PATENT DOCUMENTS

| | | | | |
|---|---|---|---|---|
| 6,428,906 | B1 * | 8/2002 | Wong | G11B 5/656 204/192.2 |
| 2003/0113582 | A1 * | 6/2003 | Litvinov | G11B 5/84 428/833.1 |
| 2004/0067154 | A1 | 4/2004 | Kanekiyo | |
| 2004/0134565 | A1 | 7/2004 | Sun et al. | |
| 2004/0183702 | A1 | 9/2004 | Nachtigal et al. | |
| 2006/0225535 | A1 | 10/2006 | Mainwaring | |
| 2009/0242826 | A1 | 10/2009 | Harada et al. | |
| 2010/0054981 | A1 | 3/2010 | Liu | |
| 2010/0218858 | A1 | 9/2010 | Baker et al. | |

FOREIGN PATENT DOCUMENTS

| | | |
|---|---|---|
| JP | 2014-105376 A | 6/2014 |
| WO | 2013/010173 A1 | 1/2013 |

OTHER PUBLICATIONS

P. Manchanda, et al., "Transition-metal and metalloid substitutions in L10-ordered FeNi", Journal of Applied Physics, May 7, 2014, vol. 115, No. 17, 3 pgs.

Swartzendruber, L.J., et. al., "The Fe—Ni (Iron-Nickel) System", National Institute of Standards and Technology, Journal of Phase Equilibria vol. 12, No. 3 1991, pp. 288-312.

Goldstein, J.I., et. al., "Iron meteorites: Crystallization, thermal history, parent bodies and origin", ScienceDirect, Chemie der Erde 69 (2009), pp. 293-325.

* cited by examiner

RARE EARTH-FREE PERMANENT MAGNETIC MATERIAL

SUMMARY OF THE INVENTION

The invention provides rare earth-free permanent magnetic materials and methods of making them.

One aspect of the invention is a nanostructured magnetic alloy composition. The composition contains an iron-nickel alloy substituted with one or more doping elements that introduce vacancies in the iron-nickel alloy structure or substitute for iron or nickel atoms. The alloy has the general formula $Fe_{(0.5-a)}Ni_{(0.5-b)}X_{a+b)}$, wherein X is Ti, V, Al, S, P, B, or C, and wherein $0<(a+b)\leq 0.1$. The composition contains $L1_0$ phase structure and has permanent magnetic properties. Another aspect of the invention is a magnet that contains the nanostructured alloy composition. In some embodiments the alloy composition is substantially or essentially free of rare earth elements.

Yet another aspect of the invention is a method of making the nanostructured magnetic alloy composition just described. The method includes the steps of: (a) preparing a melt containing Fe, Ni, and one or more elements selected from the group consisting of Ti, V, Al, S, P, B, and C, wherein the ratio of elements in the melt is according to the formula $Fe_{(0.5-a)}Ni_{(0.5-b)}X_{(a+b)}$, and wherein X is Ti, V, Al, S, P, B, or C, and wherein $0<(a+b)\leq 0.1$; (b) cooling the melt by a melt spinning process, whereby the melt is converted into a solid form; (c) mechanically milling the solid form, whereby the solid form is reduced to a plurality of nanoparticles; and (d) compressing the nanoparticles to form a nanostructured magnetic alloy composition.

Still another aspect of the invention is a magnetic nanocomposite material containing a first phase and a second phase. The first phase contains MnAlC material having $L1_0$ structure, and the second phase contains Fe. The first and second phase materials are in the form of nanoparticulates compressed together to form a composite. In some embodiments the nanocomposite material is substantially or essentially free of rare earth elements.

Another aspect of the invention is a method of making a rare-earth free nanocomposite exchange spring permanent magnetic material. The method includes the steps of: (a) preparing a melt comprising Mn, Al, and C; (b) cooling the melt by a melt spinning process, whereby the melt is converted into a solid form; (c) heat treating the solid form to produce $L1_0$ phase therein; and (d) mechanically milling the heat treated solid form in the presence of a surfactant and Fe or an alloy of Fe and Co to form the magnetic nanocomposite, wherein the nanocomposite is in the form of a plurality of nanoparticles.

Other features and advantages of the invention will be apparent from the following description of the preferred embodiments thereof and from the claims, taken in conjunction with the accompanying drawings.

DETAILED DESCRIPTION OF THE INVENTION

Figure 1:
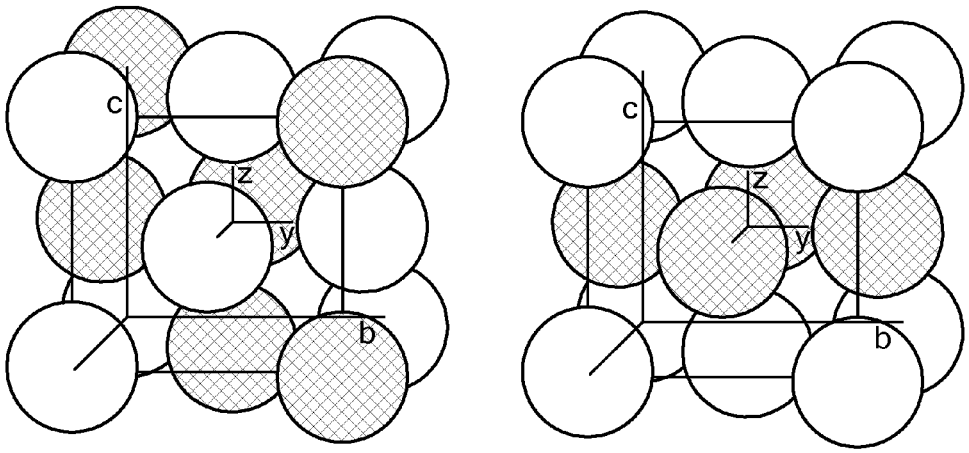
FIG. 1 shows the chemically-disordered fcc (A1) binary crystal structure (left side) and the chemically ordered $L1_0$ (AuCu I) crystal structure (right side).

The inventors have developed rare earth-free permanent magnetic materials that can be used to produce magnetic structures for use in a wide variety of commercial applications, such as motors, generators, and other electromechanical and electronic devices. Because the materials do not rely on rare-earth elements to achieve high magnetization and anisotropy, they can be substituted for magnets requiring lanthanides that are costly and in limited supply.

The invention provides two different types of embodiments, each of which achieves desirable permanent magnetic properties using a different approach. The first type utilizes an essentially equimolar iron-nickel alloy that is doped with small amounts of one or more doping elements. The doping elements are used to promote the formation of $L1_0$ crystal structure, which is associated with permanent magnetic properties in certain meteorites. The second type takes the form a nanocomposite particle containing a composite of nanoscale hard and soft magnetic phases that interact to form an "exchange spring" magnetic material. The hard phase contains iron and/or an FeCo alloy. The soft phase contains an AlMnC alloy. The nanocomposite material is composed of nanosize particles. As used herein, "nanosize" refers to structures that have a size (e.g., a mean particle diameter) of preferably 100 nm or less. In certain embodiments, nanosize structures are less than 50 nm, less than 100 nm, less than 500 nm, or less than 1000 nm, and are at least 1 nm, or at least 10 nm in size.

The magnetic materials described herein preferably do not contain any rare-earth elements, i.e., they are substantially or essentially free of rare-earth elements such as neodymium and samarium. In some embodiments, rare-earth elements can be included in small amounts, or may be present in trace amounts.

The first type of permanent magnetic material according to the invention is based on a FeNi alloy having $L1_0$ crystalline structure. Compounds of tetragonal crystal symmetry with $L1_0$ structure such as FePt and FePd possess high magnetization and significant magnetocrystalline anisotropy, derived from the lower-symmetry crystal structure, necessary for advanced permanent magnet applications. However, the costliness of Pt and Pd preclude their use as components in bulk permanent magnets for motors and generators. The isoelectronic composition FeNi, on the other hand, contains much less expensive and readily available constituents. Importantly, formation of FeNi in the $L1_0$ structure has recently been observed under certain conditions in the laboratory as well as in selected meteorites, and is confirmed to exhibit a high magnetization (1.6 T—equivalent to $Nd_2Fe_{14}B$) and high anisotropy. However, $L1_0$ FeNi possesses a low chemical ordering temperature of 320 C (compared with ~1300 C for FePt), indicating that the disorder to order transformation in FeNi is kinetically limited on account of low atom mobilities at low temperatures.

In the present invention, chemical ordering is induced in nominally-equiatomic FeNi so that $L1_0$ structure more easily forms. This results in a less costly, non-RE-based advanced permanent magnetic material.

The invention provides a method of fabricating an FeNi alloy having the $L1_0$-type crystalline structure, (a.k.a. tetrataenite). This structure has recently been observed under certain conditions in the laboratory as well as in selected iron-nickel meteorites. Tetrataenite possesses a high magnetization (1.6 T, equivalent to $Nd_2Fe_{14}B$) and high anisotropy. However, it exhibits and unacceptably low chemical ordering temperature of 320° C., indicating that the order-to-disorder transformation in FeNi is kinetically limited on account of low atom mobilities characteristic at temperatures below the ordering temperature. The invention correlates the structure, phase stability, and magnetic response of both substitutional (Ti, V, Al) and interstitial (B and C) additions into the FeNi lattice to stabilize the chemical ordering. Other elements, including S and P, may also be included as either substitutional or interstitial additions. It thereby achieves an economical, advanced permanent magnetic material that is not based on rare earth elements.

One aspect of the invention is a nanostructured magnetic alloy composition. The composition contains an alloy of the general formula $Fe_{(0.5-a)}Ni_{(0.5-b)}X_{(a+b)}$. The FeNi lattice is substituted with a doping element, X, which is one or more of the elements selected from Ti, V, Al, S, P, B, and C. The amount of X substituted into the FeNi lattice is not more than 10% on a mole fraction basis (i.e, $0<(a+b)\leq 0.1$). In certain embodiments, the amount of X substituted into the FeNi lattice is at least 0.1% on a mole fraction basis (i.e., $(a+b)\geq 0.001$). In other embodiments, the amount of X is at least 0.2%, 0.3%, 0.5%, or 1% on a mole fraction basis. The composition contains $L1_0$ phase structure. Another aspect of the invention is a permanent magnet containing the magnetic alloy composition of the invention.

The invention also contemplates a method of making the nanostructured magnetic alloy composition. The method includes the steps of: (1) preparing a melt containing Fe, Ni, and one or more elements selected from the group consisting of Ti, V, Al, S, P, B, and C. The ratio of elements in the melt follows the formula $Fe_{(0.5-a)}Ni_{(0.5-b)}X_{(a+b)}$, wherein X is Ti, V, Al, S, P, B, or C, and wherein $0<(a+b)\leq 0.1$; in certain embodiments, the amount of X added is at least 0.1%, 0.2%, 0.3%, 0.5%, or 1% on a mole fraction basis; (2) cooling the melt by a melt spinning process, whereby the melt is converted into a solid form; (3) mechanically milling the solid form, whereby the solid form is reduced to a plurality of nanoparticles; and (4) compressing the nanoparticles to form a nanostructured magnetic alloy composition.

Among the various sources of magnetic anisotropy, including magnetocrystalline, shape, and stress, magnetocrystalline anisotropy provides the largest anisotropy and is thus the favored mechanism to induce coercivity in high-energy permanent magnets. The production of rare-earth-free permanent magnetic materials with high-energy products $(BH)_{max}$ requires that the principle source of the exceptional anisotropy, the magnetocrystalline anisotropy arising from the 4 f electronic state, is no longer available for exploitation. This magnetocrystalline anisotropy is recovered in the magnetic materials of the present invention in that the materials adopt a low symmetry crystal structure, such as hexagonal or tetragonal crystal structures. In low-symmetry crystal structures, the material's magnetic moment may align perpendicular to the basal plane direction, providing two energy minima for the magnetization that define the uniaxial magnetic anisotropy state. The majority of strongly-magnetic transition-metal alloys assume a high-symmetry cubic structure that displays low magnetocrystalline anisotropy. The materials of the present invention, however, exploit the structural and magnetic attributes of the $L1_0$ family of transition-metal-based materials, specifically FeNi with ternary alloying additions.

The $L1_0$ structure forms in (nearly) equiatomic compounds of general formula AB. FIG. 1 illustrates the $L1_0$ (AuCu I) structure that consists of alternating layers of the two constituent elements stacked parallel to the tetragonal c-axis, creating a natural superlattice. The Strukturbericht designation of this superlattice structure is $L1_0$. If the unit cell is taken as the left figure, the Pearson symbol is tP4, with the space group P4/mmm, and the prototype CuAu I. The ordered $L1_0$ alloys of the present invention form through a disorder-order transformation from a parent phase, which is often a chemically disordered, face centered cubic (fcc) solid solution of the two elements. The decrease in symmetry concurrent with the formation of the $L1_0$ structure leads to a tetragonal distortion, which usually, though not always, results in a contraction in the unit cell c-axis, [001]. For bulk $L1_0$ FePt, the tetragonal distortion is a contraction along the c-axis, with a=b=0.3852 nm, c=0.3713 nm, and c/a=0.96 at room temperature.

In the fcc or A1 structure, the probability of occupation of a given atomic site by either of the two component elements is equal. By contrast, in the ordered structure, which is the thermodynamically stable phase below a critical temperature $T_{CR}$, each crystal lattice site has a different probability of being occupied by one of the two atom types. In ferromagnetic systems, the critical order-disorder temperature can vary widely. For example, for equiatomic (thermodynamically stable) FePt $T_{CR}$ is 1300° C., whereas for equiatomic (thermodynamically metastable) FeNi it is significantly lower at 320° C. By symmetry arguments, it can be shown that the A1 to $L1_0$ phase transformation is first order in the Ehrenfest sense. This has been shown to be true for the ordering process in ultrathin films (10 nm) of CoPt and FePt. This first-order transformation proceeds by nucleation and growth of the $L1_0$ ordered regions within the disordered A1 matrix. The local atomic rearrangements necessary for ordering can be facilitated by creating point defects (vacancies) in the structure, or by ternary alloying additions that enhance diffusion rates.

Calculations of the stability of $L1_0$ compounds compiled by the Center for Atomic-scale Materials Physics at the Denmark Technical University (CAMP-DTU) (databases-.fysik.dtu.dk/index.php) can be used to estimate the effects of substitutional elements Ti, V, C, S, and P. Ti and V form stable $L1_0$ compounds with Ni (i.e., Ti and V have negative heats of formation values of −28.2 and −14.8 kJ/mole atom, respectively for $L1_0$ TiNi and VNi), while Al forms stable $L1_0$ phases with both Fe and Ni (with first principles calculated heats of formation values of −22.9 and −49.8 kJ/mole atom for $L1_0$ FeAl and NiAl, respectively). The $L1_0$ phase is metastable relative to other equilibrium structures in some of the respective binary systems, whereas it is the equilibrium phase for others. For example, in the Ni—Al system, the thermodynamically stable structure at the 50-50 composition is the ordered B2 NiAl phase. Nevertheless, the calculated heat of formation of $L1_0$ NiAl is −49.8 kJ/mole atoms, which makes it a very stable compound indeed. By contrast, in the Ti—Al system, $L1_0$ TiAl is a thermodynamically stable compound up to its melting, which is in the range of 1400° C. The first-principles calculated heat of formation of $L1_0$ TiAl is −37.8 kJ/mole atoms.

The interstitial alloying addition C is known to stabilize the metastable $L1_0$ phase in other systems, such as the τ-MnAl, whose calculated heat of formation is only −0.8 kJ/mole atoms, significantly lower than for $L1_0$ FeNi at −4.5 kJ/mole atoms and because C is known to lead to the formation of the tetragonal phase (martensite) in Fe upon rapid quenching, noting that the formation of the ordered $L1_0$ phase from the disordered cubic is accompanied with a tetragonal distortion. The other interstitial alloying additions B, S, and P are alternatives to the impact of C.

Figure 2:
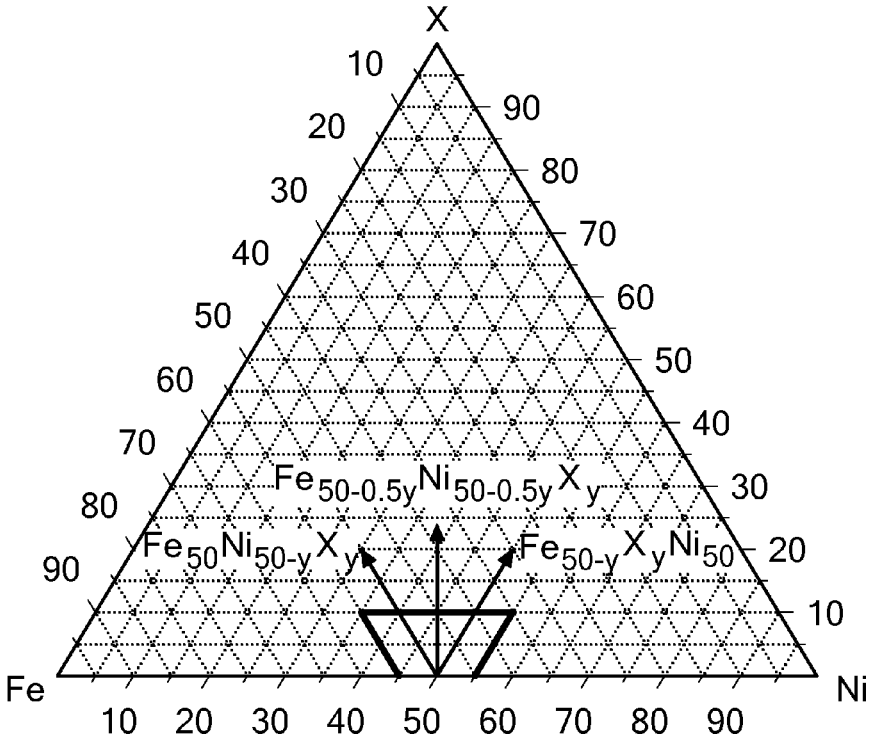
FIG. 2 shows a scheme for additions of ternary alloying element(s), X, to Fe—Ni. X can be Ti, V, Al, S, P, B, or C.

A scheme for ternary alloying additions to Fe—Ni is presented in FIG. 2. The allowing addition element, X, can be Ti, V, Al, S, P, B, or C. The alloy compositions are limited to within the inverted trapezoid at the bottom, with the amount of X additions no greater than 10 at %. The deposited alloy compositions can follow three paths within the trapezoid as given by the arrows. Along one of the outer paths, % Fe is kept fixed (at 50% for example), while the % Ni and % X are varied. Along the second outer path % Ni can be kept fixed (at 50 at % for example) while % Fe and % X are varied. Along the middle path, the amount of X can be varied such that the ratio of Fe to Ni is kept fixed at 1:1. The arrows are extended outside of the trapezoid for clarity.

Binary Fe—Ni materials with compositions in the range of 45-55 at % Ni (i.e., within 5 at % on either side of the equiatomic composition) are preferred. The addition of the ternary alloying elements X (where X=Ti, V, Al, S, P, B, or C) can be limited to the region outlined by the inverted trapezoid shown in FIG. 2. For alloys within this region the maximum amount of the ternary addition X is limited to 10 at % so as to keep the impact on the magnetic properties small, given that all of the preferred ternary additions are non-magnetic. The additions within the trapezoid region can follow broadly the paths indicated by the arrows shown in FIG. 2. Along one of the limiting paths, the Fe content is fixed (at 50% for example), while the % Ni and % X contents are varied. Along the second path the % Ni can be kept fixed and % Fe and % X are varied. Along the middle path, the amount of X can be varied, while keeping the Fe to Ni ratio fixed at 1:1. The choice of the three paths for alloy compositions can be used to compare the ternary alloys with the equivalent binary alloys to assess the impact of the alloying additions on the stabilization of the $L1_0$ phase and on the kinetics of its formation.

In order to fabricate bulk magnetic material according to the invention, an initial alloy of the ternary mixture is prepared, e.g., via arc melting. After initial alloying, bulk material production employs the non-equilibrium techniques of melt-spinning for synthesis and mechanical milling for processing. Melt-spinning is widely used to rapidly solidify materials. Melt spinning is carried out using a Melt Spinner. Conditions for melt spinning require a temperature greater than the melting temperature of the alloy, e.g., T~1520 C. The wheel speed can be, for example, 5-60 m/sec, and the melt-spinning operation is performed in an atmosphere of argon or helium. The high cooling rate associated with melt spinning provides a large undercooling, which in turn enhances nucleation rates and minimizes growth, resulting in nanoscale structures such as nanoparticles. Alternatively, in some alloy systems nucleation can be suppressed so that melt spinning results in a metallic glass. The magnetic properties are especially sensitive to microstructure, such that control to the nanometer length scale is necessary.

High-energy mechanical milling is a processing technique that is well known to create a significant number of defects, including point defects, that facilitate alloying and metastable phase formation. High-energy ball milling can be conducted at ambient temperature. Vials and balls can be of any hard material, and the ball-to-powder ratio can be varied at least over the range from about 2:1 to about 15:1. A SPEX 8000 mixer/mill is one suitable device. The milling time will be influenced by the ball-to-powder ratio, but by way of example can be a few hours, such as less than about 3 hours. In general, ball milling results in the comminution and re-forming of powders arising from high-energy collisions that occur when the powder gets caught between rapidly moving, hard balls, or between the hard balls and walls of the containment vessel. The multiple fracturing and re-welding process results in grain size reduction, amorphization, and/or alloying. The process generally takes place in an inert atmosphere at ambient temperatures; however, low-temperature (e.g., cryogenic temperatures) also can be used. Also, the re-welding/re-formation which occurs during ball milling can be reduced or eliminated by using surfactant-assisted mechanical milling.

Mechanical milling affects the A1 to $L1_0$ transformation in FeNi. It is noted that mechanical milling typically produces a large temperature increase in the processed material. As the order-disorder transformation in $L1_0$—type FeNi is comparatively low (320° C.), cryomilling can be used, in which the sample is milled in a cryogen (e.g., liquid nitrogen or liquid argon) slurry or at cryogenics temperature to produce nanostructured material. Intermittent milling also can be used to prevent temperature spikes during the milling process. The material formed can be analyzed using techniques including differential scanning calorimetry, magnetic force microscopy, transmission electron microscopy, energy dispersive x-ray spectrometry, x-ray absorption spectroscopy, x-ray magnetic circular dichroism, x-ray diffraction, and electron diffraction.

Figure 3:
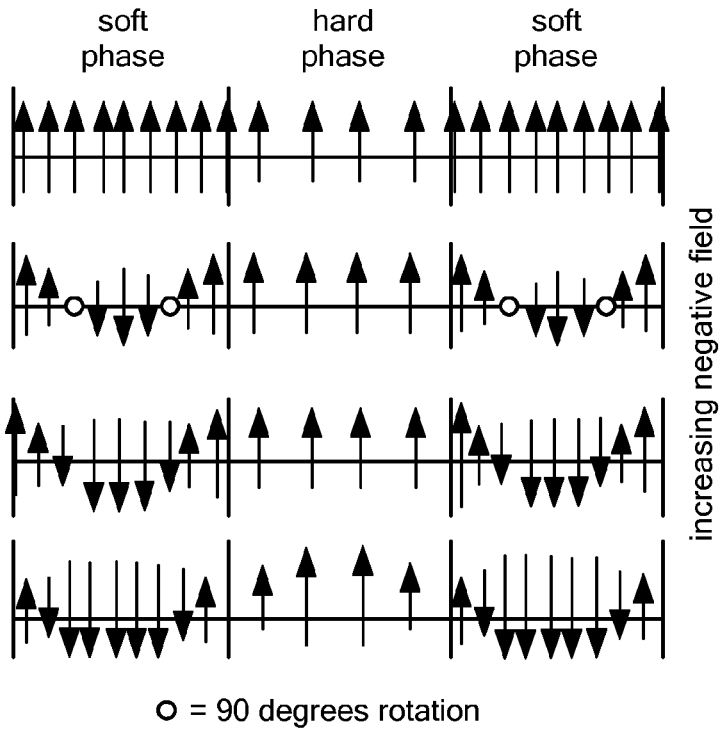
FIG. 3 shows a diagram of the principle of operation of exchange spring magnetic materials. A hard phase stiffens the response of a soft high magnetization phase in magnetic nanocomposite structures.

Another aspect of the invention is a method of making a rare-earth free nanocomposite permanent magnetic material. As referred to herein, the term "nanocomposite" refers to a composite containing particles (e.g., crystallites) whose size (e.g., diameter) is in the nanometer size range, i.e., from about 1 to about 100 nm in size, or from about 1 to about 200 nm, 500 nm, or 1000 nm in size. The nanocomposite material can form particles whose size is larger than the nanometer size range, e.g., in the micron size range greater than 1 micron in size. The nanoscale magnetic composites described herein are characterized as comprising nanoscale precipitates of a magnetically-hard transition-metal-based intermetallic compound dispersed in an iron-rich matrix. The material forms what is known as an "exchange spring" magnet. The intermetallic interstitially-modified ferromagnetic material MnAlC and the ferromagnetic metal Fe or FeCo are combined in mechanically-reduced form and are intimately mixed using the process of surfactant-assisted ball milling in oleic acid. The nanocomposite system contains intimately combined nanoscale magnetically hard and magnetically-soft phases that are quantum-mechanically exchange-coupled at their mutual interface (see FIG. 3). The interfacial magnetic exchange coupling produces a composite system that exhibits the best attributes of the constituent phases. The hard phase furnishes high anisotropy and accompanying high coercive fields, while the soft phase furnishes a large saturation magnetization.

Theoretical work has suggested that energy products of such nanocomposite magnetic materials could significantly surpass those provided by conventional uncoupled magnetic materials, and published experiments have verified that energy products are increased. However, previously the technical magnetic properties of the resultant products have not come close to their theoretical promise due to issues of phase purity, uniformity and crystallographic alignment. These extrinsic factors have been controlled in the presently described system to yield a superior response due to the nanoscale size of the individual magnetic phase materials.

In some embodiments, the nanocomposite does not contain cobalt. However, the magnetic properties, in particular the Curie temperature as well as the microstructure, can be improved with the addition of Co on the order of 15-20% by weight. The nanocomposite compositions according to the invention exhibit Hci of 4 kOe or higher. The Curie temperature (Tc) is between 400° C. and 500° C.

The magnetic nanocomposite according to this embodiment is suitable for use as a replacement for lower-end (isotropic) rare-earth-containing magnets that possess energy products ($BH_{max}$) in the range of 10 to 12 MGOe at room temperature. The nanocomposite system described herein is fabricated by non-equilibrium synthesis and processing methods that are designed to kinetically achieve metastable nanoscale magnetic phases and structures that remain inaccessible with conventional metallurgical processing methods. The magnetic materials that make up the system are preferably free of rare-earth elements, although in some embodiments rare earth elements are present. The constituent elements are inexpensive and abundant, and they offer life-cycle sustainability as well as corrosion resistance which is improved over magnetic materials containing rare-earth elements. The operating temperature, determined by the Curie temperature of the magnetically-hard phase, is in the vicinity of 400° C., sufficiently high to maintain good magnetic performance to 150° C. The relevant hard magnetic phase(s) in the nanocomposite have a high magnetocrystalline anisotropy (K1 of $10^7$ ergs/cm$^3$; anisotropy field HA of about 40 kOe) so as to ensure attainment of a coercivity sufficient for permanent magnet applications in the specified temperature range (1Hc of −4 kOe). The nanocomposite materials have relatively high saturation magnetizations greater than 7 kG so that theoretical energy products exceed 12 MGOe. Current high-energy permanent magnets such as those based on $Nd_2Fe_{14}B$ achieve almost ninety percent of the theoretical maximum. The nanocomposite materials described herein have remanence (Br) exceeding 6 kG and energy products exceeding 10 MGOe at room temperature, and these attributes are expected to increase at temperatures below room temperature.

In order to make the nanocomposite materials, materials of general composition MnAlC and MnAl are made by the rapid solidification technique of melt-spinning to create a nanocrystalline material of high homogeneity and a large degree of metastability that is amenable to the creation of small crystallites via a small input of mechanical and/or thermal energy. The melt-spun MnAlC is initially in the form of small flakes or short ribbons. Subsequently, the MnAlC flakes or ribbon pieces are combined in selected amounts ranging from 20 to 50 wt % with reduced iron or iron cobalt powder and subjected to extended mechanical mixing, such as ball milling, in the presence of a surfactant, such as oleic acid, which is designed to allow the constituents to resist interdiffusion and retain their essential chemical compositions. All powder handling is preferably performed in the absence of air or oxygen in order to avoid oxidation. For example, the powder handling procedures can be performed in a nitrogen or argon atmosphere. The product of the milling process is an isotropic powder mixture of MnAlC and Fe (or FeCo), the particles of which are intimately mixed on the nanoscale, and has enhanced interphase exchange coupling derived from the extremely large surface: volume ratio attained by the process. Powders can be compressed using known methods into any desired shape as required for evaluation or use. The powders can be compacted into any desired shape as required for evaluation or use. Examples of methods that can be used to obtain magnetic material compacts include those utilized to produce MQ-1 (cold-pressed in an epoxy matrix) and MQ-2-type (hot-pressed) 2-14-1 (i.e., $Nd_2Fe_{14}B$) magnets and microwave sintering. Hot- and cold-pressed compacts of $L1_0$ materials according to the invention can be prepared using conventional consolidation techniques or roll-forging or shock consolidation techniques. This embodiment of the invention provides a magnetic nanocomposite that can replace isotropic rare-earth-containing magnets with energy products in the range of 10 to 12 MGOe at room temperature, a Curie temperature of approximately 400° C., sufficient to maintain good magnetic performance up to 150° C., an intrinsic coercivity of kOe, and a saturation magnetizations greater than 7 kG.

The combination of materials and the methods described herein can be used to make a novel magnetic monolithic compact. In particular, the combination of processing steps used in the present invention is necessary to create a nanocomposite from the specified materials. Earlier approaches to the synthesis of hard magnets did not create nanocomposites, but used iron-based alloys containing a second, non-magnetic, micron-scale phase to pin magnetic domain walls within the material. Such inclusion-hardened magnets, typically martensitic steels, have maximum coercivities in the range of a few hundred oersteds. The introduction of shape anisotropy was previously known to raise the maximum coercivity to close to 1000 Oe in the AlNiCo series of permanent magnets. See, e.g., Former approaches to the creation of magnetic nanocomposites for hard magnet applications, using different alloy compositions than used in the present invention, have been limited to melt-spinning, crushing the resulting ribbons and compacting, or to ball-milling the materials in an inert atmosphere and compacting the product. A significant disadvantage of former approaches to the creation of hard nanocomposite magnets is that they all contain rare earth elements, which are strategically difficult and expensive to procure, as well as challenging to process. See, e.g., J. W. Cahn, J. Appl. Phys., 1963, vol. 34, pp. 3581-3586; P. Marin and A. Hernando, Appl. Phys. Lett., 2009, vol. 94, pp. 122507-1-3; L. I. Mendelsohn, F. E. Luborsky and T. O. Paine, J. Appl. Phys., 1955 vol. 26, pp. 1274-1280; and F. E. Luborsky, L. I. Mendelsohn and T. O. Paine, J. Appl. Phys., 1957, vol. 28, pp. 344-350.

The nanocomposite method described herein allows for the creation of rare earth-free permanent nanocomposite magnets. Unlike prior approaches, the present invention combines known materials to create a new nanocomposite material with exchange coupling at the atomic level. The entire compact is free of rare-earth elements. Thus, advantages of the present invention over former approaches include the lack of rare-earth elements in the chemical composition, the attendant reduction in cost, simplification of processing and handling, and a ready global supply of the constituents.

The nanocomposite materials produced using the present method exploit the technical magnetic properties of non-rare-earth magnetic materials with tetragonal $L1_0$ structure. In contrast, the majority of strongly-magnetic transition-metal alloys assume a high-symmetry cubic structure that displays low magnetocrystalline anisotropy. The present materials, however, are nanocomposite exchange spring permanent magnetic materials comprising interstitially-modified ferromagnetic MnAlC nanoparticles combined with Fe or FeCo nanoparticles to form a nanocomposite. The materials of the present invention inherently possess high magnetization and high anisotropy. Analysis of the intrinsic magnetic properties of the $L1_0$-based system indicates a $(BH)_{ma}$, of >12 MGOe for the MnAlC/FeCo nanocomposite.

The methods of the invention include processing of intermetallic interstitially-modified ferromagnetic material MnAlC nanoparticles together with the ferromagnetic metal Fe or FeCo nanoparticles. These two types of materials are combined in mechanically-reduced form and are intimately mixed using high-energy ball milling, and subsequently subjected to surfactant-assisted ball milling to create a nanocomposite. The method applies the non-equilibrium processing techniques of meltspinning and surfactant-assisted mechanical milling to synthesize and combine interstitially-modified $L1_0$-type, Mn-rich compound (MnAl(C)) with high-moment Fe or FeCo at the nanoscale to create a nanocomposite magnetic system—a magnetic "exchange spring"—that exhibits the best technical attributes of both constituent phases.

In a preferred embodiment, a method of making a magnetic nanocomposite includes the steps of: preparing a melt comprising Mn, Al, and C; cooling the melt by a melt spinning process, whereby the melt is converted into a solid form containing MnAl(C); heating the solid form to convert at least a portion thereof into $L1_0$ structure; and mechanically milling the solid form in the presence of a surfactant such as oleic acid and Fe or an alloy of Fe and Co containing not more than about 35% Co, such as oleic acid, whereby the solid form is reduced to a plurality of nanoparticles or crystallites containing the magnetic nanocomposite. The individual crystallites (i.e., individual nanoparticles of Fe or FeCo and MnAl(C)) have an average diameter of less than about 100 nm. In some embodiments, the size of the nanoparticles is in the range from about 30 nm to about 100 nm. The nanoparticles are fused into composite particles having a size in the micron range, e.g., on the order of about 50 microns in diameter, or in the range from about 1 micron to about 100 microns in diameter. In a preferred embodiment, the ratio of Mn to Al is about 1:1. However, the composition can be either slightly Mn-rich or Al-rich, such as having a Mn:Al ratio in the range from about 40:60 to about 60:40, or from about 42:58 to about 58:42, or from about 44:56 to about 56:44. In a preferred embodiment, the ratio of Mn:Al:C is about 54:44:2. In another preferred embodiment, the Mn content is in the range from about 51 to about 54 mol %, the C content is about 3 mol %, and the balance (to a total of 100 mol %) is Al.

Figure 4:
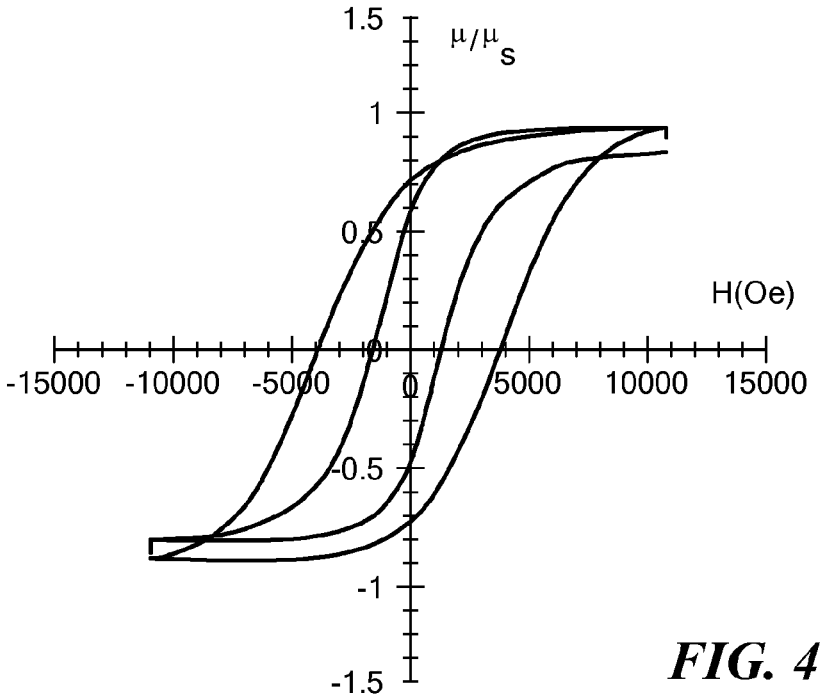
FIG. 4 shows hysteresis loops of T-MnAl(C) produced by melt spinning/heat treatment prior to subsequent mechanical milling and after mechanical milling for 0.5 h. Mechanical milling of T-MnAl(C) reduces the grain size, resulting in a dramatic increase in coercivity to 4800 kOe.

The melt-spinning process is designed to produce nanoscale phases and structures. In the case of MnAl(C), melt spinning produces the s phase, from which the $L1_0$ phase is derived via heat treatment. The phase of the MnAl(c) material is then combined with Fe or Fe(Co) and mechanically milled to form hard/soft nanocomposite structures. The mechanical milling reduces the MnAl(C) grain size, enhancing coercivity, and reducing the scale of the soft magnetic phase to create an intimate mixture of the two phases that results in exchange coupling. Mechanical milling of single T-MnAl(C) effectively reduces the grain size, resulting in a dramatic increase in coercivity to 4800 kOe (see FIG. 4).

Figure 5:
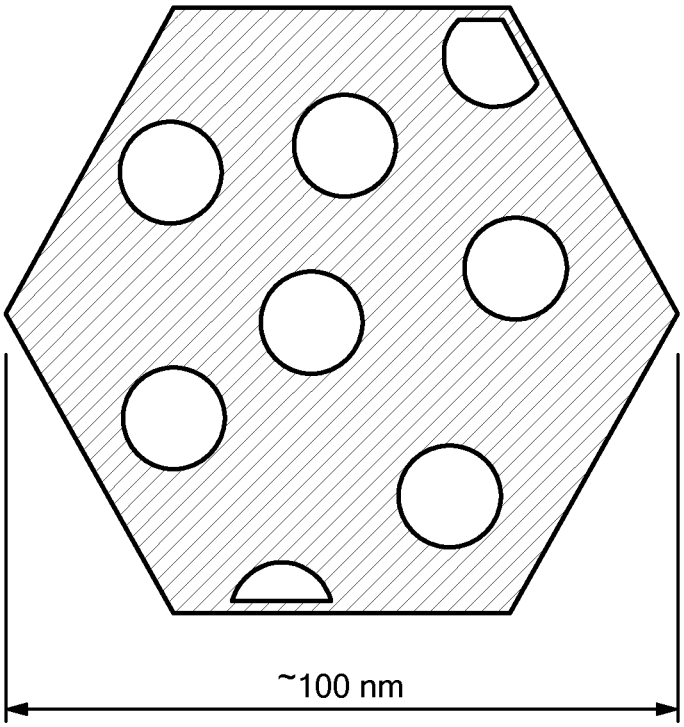
FIG. 5 shows a model of the general structure of a nanocomposite according to the invention. The model depicts a MnAl(C)/Fe nanocomposite particle after a three-step processing scheme. The white regions represent soft magnetic phase (MnAl(C)) imbedded in a hard magnetic matrix (dark regions, Fe or Fe/Co alloy).

The final stage of processing is surfactant-assisted mechanical milling. This step engineers another length scale into the structure, resulting in nanoparticles having a general structure as shown in FIG. 5. The surfactant allows overall particle size to be reduced by preventing re-welding. A preferred surfactant is oleic acid, but other fatty acids can also be used. The final structure resulting from the fabrication process consists of particles whose diameter is in the micron range, wherein the particles are a composite of nanocrytalline hard and soft phases whose crystallite size is below the single-domain limit (about 100 nm). Ideally, the crystallite size is uniform. The nanocomposite particles can then be pressed into any desired shape using standard techniques, such as the hot- or cold-pressed compacts described earlier to form a magnet.

The magnetic properties of the material, such as its energy product, are determined. The material preferably should have a smooth single-phase demagnetization curve. Techniques that can be used to characterize the magnetic materials described herein include, but are not limited to, differential scanning calorimetry, magnetic force microscopy, transmission electron microscopy, scanning electron microscopy, energy dispersive x-ray spectrometry, x-ray absorption spectroscopy, x-ray magnetic circular dichroism, x-ray diffraction, electron diffraction, scanning probe microscopy (MFM), element-specific spectroscopy, thermal analysis of magnetic properties, and magnetometry (e.g., SQUID (superconducting quantum interference device) and VSM (vibrating sample magnetometer)

While the present invention has been described in conjunction with certain preferred embodiments, one of ordinary skill, after reading the foregoing specification, will be able to effect various changes, substitutions of equivalents, and other alterations to the compositions and methods set forth herein.

As used herein, "consisting essentially of" does not exclude materials or steps that do not materially affect the basic and novel characteristics of the claim. Any recitation herein of the term "comprising", particularly in a description of components of a composition or in a description of elements of a device, can be exchanged with "consisting essentially of" or "consisting of".

That which is claimed is:

1. A bulk magnetic alloy composition, the composition comprising an alloy having the formula $Fe_{(0.5-a)}Ni_{(0.5-b)}X_{(a+b)}$, wherein X is Ti, V, Al, S, P, B, or C, and wherein $0<(a+b)\leq 0.1$, wherein the composition comprises $L1_0$ phase structure.

2. A permanent magnet comprising the composition of claim 1.

3. A method of making the nanostructured magnetic alloy composition of claim 1, the method comprising the steps of:

preparing a melt comprising Fe, Ni, and one or more elements selected from the group consisting of Ti, V, Al, B, and C, wherein the ratio of elements in the melt is according to the formula $Fe_{(0.5-a)}Ni_{(0.5-b)}X_{(a+b)}$, wherein X is Ti, V, Al, S, P, B, or C, and wherein $0<(a+b)\leq 0.1$;

cooling the melt by a melt spinning process, whereby the melt is converted into a solid form;

mechanically milling the solid form, whereby the solid form is reduced to a plurality of nanoparticles; and compressing the nanoparticles to form a nanostructured magnetic alloy composition.

* * * * *